US008522584B2

(12) United States Patent
Dolev

(10) Patent No.: US 8,522,584 B2
(45) Date of Patent: Sep. 3, 2013

(54) HIGH-SECURITY ROTATING BOLT LOCK

(76) Inventor: Moshe Dolev, Ramat Hasharon (IL)

( * ) Notice: Subject to any disclaimer, the term of this patent is extended or adjusted under 35 U.S.C. 154(b) by 972 days.

(21) Appl. No.: 12/040,893

(22) Filed: Mar. 2, 2008

(65) Prior Publication Data

US 2009/0031769 A1 Feb. 5, 2009

Related U.S. Application Data

(63) Continuation-in-part of application No. 11/423,959, filed on Jun. 14, 2006, now Pat. No. 7,343,763.

(60) Provisional application No. 60/956,725, filed on Aug. 20, 2007.

(51) Int. Cl.
*E05B 17/04* (2006.01)
*E05B 9/10* (2006.01)

(52) U.S. Cl.
USPC ..... 70/379 R; 70/118; 70/380

(58) Field of Classification Search
USPC ..... 70/379 R, 118, 120, 38, 92, 103, 70/106, 141, 171, 379 A, 380
See application file for complete search history.

(56) References Cited

U.S. PATENT DOCUMENTS

| | | | | |
|---|---|---|---|---|
| 2,637,196 | A | 5/1954 | Seaver et al. | |
| 3,991,595 | A | 11/1976 | Bahry et al. | |
| 4,154,070 | A | 5/1979 | Bahry et al. | |
| 4,229,958 | A | 10/1980 | Burger | |
| 4,878,367 | A | 11/1989 | Bisbing | |
| 5,577,409 | A | 11/1996 | Oyabu et al. | |
| 5,577,780 | A | 11/1996 | Justice | |
| 5,782,118 | A | 7/1998 | Chamberlain | |
| 6,158,259 | A | 12/2000 | Schmitz | |
| 6,363,762 | B1 | 4/2002 | Kuong | |
| 6,508,088 | B1 * | 1/2003 | Barbier et al. | 70/186 |
| 6,523,377 | B1 | 2/2003 | Vontannthen | |
| 6,834,520 | B2 | 12/2004 | LaConte et al. | |
| 2004/0237611 | A1 | 12/2004 | Artsiely | |

FOREIGN PATENT DOCUMENTS

| | | | |
|---|---|---|---|
| DE | 3626551 | A1 * | 2/1988 |
| EP | 72332 | A1 * | 2/1983 |
| FR | 2551126 | A1 * | 3/1985 |

* cited by examiner

*Primary Examiner* — Carlos Lugo
*Assistant Examiner* — Alyson M Merlino
(74) *Attorney, Agent, or Firm* — Dekel Patent Ltd.; David Klein

(57) ABSTRACT

A cylinder lock having a body and a modified cam, the cylinder lock being adapted for moving an external element arranged to engage the modified cam, so that the external element slides axially on the cylinder lock body. In a preferred embodiment, the inventive cylinder lock is designed to utilize a helical cam which engages a movable external element or slider, and this design is referred to as the HC cylinder lock. When operated by rotating the appropriate key within it, the movable external element can be moved in a linear fashion along the length of the HC cylinder lock thus converting rotational motion of the key to axial motion of the external element. The external element is arranged to engage an eccentric pin formed as part of a rotating bolt which rotates on an orthogonal axis to the cylinder plug in response to said sliding motion, for the function of locking or unlocking a device. The streamlined design of the inventive HC cylinder lock enables efficient placement of a door lock within the hollow volume of a door to provide locking action.

15 Claims, 13 Drawing Sheets

SECTION A-A

SECTION C-C

SECTION B-B

HIGH-SECURITY ROTATING BOLT LOCK

CROSS-REFERENCE TO RELATED APPLICATIONS

The present application is a Continuation-In-Part (CIP) of U.S. patent application Ser. No. 11/423,959 filed on Jun. 14, 2006 by the Applicant and claims priority from U.S. Provisional Patent Application 60/956,325, filed Aug. 20, 2007, the disclosures of which are hereby incorporated herein in their entirety by reference.

FIELD OF THE INVENTION

The present invention relates generally to cylinder-locks, and more particularly to cylinder locks with an external element mounted so as to be arranged for motion along the length of the cylinder lock body, which engages a helical cam of the cylinder lock, thus converting rotational motion of the key to linear motion.

BACKGROUND OF THE INVENTION

The cylinder lock has been in use for more than 100 years as a standard apparatus for locking doors and other items such as containers. In common use nowadays is the European double cylinder lock apparatus 30, also known as the 'Haan' profile lock, shown in prior art FIG. 1.

The double cylinder lock apparatus 30 pictured in FIG. 1, comprises a key 32, a double cylinder lock 34, and a cam 36. The standard components mounted on the cylinder lock 30 can be seen in FIG. 2, including a rotatable cylinder plug 35 (FIG. 1) that is fastened in place by circlips 38, and rotatable cam 36 having mounted inside it a coupling assembly 40. Additional standard components such as pins and springs are not shown.

The double cylinder lock apparatus 30 is operated as follows: the key 32 is rotated inside said cylinder lock 34 and the cam 36 is consequently rotated. In a mortise-type lock construction, for example, this rotation causes a displacement of a bolt (not shown) in the tangential direction to the motion of the cam 36. The displacement of the bolt causes it, for example, to enter or exit a door jamb (not shown), that results in locking or unlocking of the door. In summary, the prior art uses a rotational motion which is converted to tangential motion in order to move said locking bolt(s).

However, this is just one type of cylinder lock given as an example of the prior art. There are a multitude of variations of shapes and sizes of cylinder locks in existence.

U.S. Pat. No. 2,637,196 to Seaver et al discloses a cylinder lock which is arranged to rotate a threaded spindle, on which a threaded sleeve is mounted. The sleeve is in front of the cylinder lock body and rotation of the lock causes the sleeve to move forward and backward.

Another prior art example is shown in FIG. 3, in which a double cylinder lock 42 fitted with a gear 44 is shown, as described in my previous work as a co-inventor, in U.S. Pat. No. 3,991,595, issued Nov. 16, 1976. The difference between FIG. 1, and FIG. 3, is that instead of a cam 36 being utilized as in FIG. 1, a gear 44 is mounted to the cylinder lock 34. The primary advantage of operating a cylinder lock 34 fitted with a gear 44 is the reduced rotational force needed to move larger or multiple locking bolts. Instead of using a single rotation of the key to provide the required force for moving the bolt(s), gear 44 can be arranged to drive a reduction gear, thus enabling the user to move the bolt(s) more easily, thus distributing the force needed to move the bolt(s) over a longer distance.

Additionally it can be seen in FIG. 4, that the only component that has been changed from FIG. 2, is the gear 44. The circlips 38 and the coupling assembly 40 remain the same in both prior art examples.

In my previous work as a co-inventor, as described in U.S. Pat. No. 4,154,070 issued May 15, 1979, a lock was disclosed that causes insertion of multiple bolts into the jamb surrounding the door in multiple directions. The disadvantage of this design is that in order to install the device, a large section of the door interior volume needs to be removed, which is a difficult, time consuming and expensive process. In addition, the door structure itself is substantially weakened, reducing overall security. The lock is made of thin sheet metal and is not strong enough.

Therefore, it would be desirable to provide an improved cylinder lock enabling design of more compact locks, with stronger materials, manufactured by advanced production technologies, at a reasonable price. The compact design will enable installation of the locks with minimal interference to the structural integrity of the door while at the same time utilizing components of the standard cylinder locks in use and in production around the world.

SUMMARY OF THE INVENTION

Accordingly, it is a principal object of the present invention to overcome the disadvantages associated with the prior art and provide a cylinder lock having a body and a modified cam, the cylinder lock being adapted for moving an external element arranged to engage the modified cam, so that the external element slides axially on the cylinder lock body.

The inventive cylinder lock enables compact design and low-cost production of various types of locks, with the entire cylinder lock being encased and fully protected from tampering or breakage by intrusion. The encased lock is designed for easy installation without weakening the door structure, and the lock utilizes as many standard components as possible to simplify and reduce the cost of the manufacturing process.

In accordance with a preferred embodiment of the present invention, there is provided in a cylinder lock constructed as a body having a cylinder plug rotatably disposed therein, said cylinder plug having both a key end and an opposite end, the improvement comprising:

a modified cam disposed at said cylinder plug opposite end, said cam having at least one thread, said cylinder lock being adapted for moving an external element arranged to engage said modified cam, said external element being arranged to slide along said cylinder lock body at least partially between said key end and said opposite end upon rotation of said cylinder plug. In a preferred embodiment, the inventive cylinder lock is designed to utilize a helical cam, and this design is hereinafter referred to as the HC cylinder lock. When the HC cylinder lock is operated by rotating the appropriate key within it, the external element is moved in a linear fashion along the length of the HC cylinder lock thus converting rotational motion to axial motion. This axial motion is used to position at least one locking bolt, of which the external element itself may be one, for the function of locking or unlocking a device.

The external element has formed therein a threaded groove matching a helical threaded section formed on the helical cam, thereby enabling engagement of the external element and cam.

The inventive HC cylinder lock construction enables more efficient usage of the hollow volume of a door for placement of a door lock incorporating the HC cylinder lock, since its streamlined design makes it possible to place it within this space.

In an alternative embodiment, the modified cam comprises a protrusion extending radially from the cylinder plug of the cylinder lock, with the protrusion being adapted to engage a helical slot formed in the external element. The inventive cylinder lock can be utilized to provide several door locking mechanisms, including a security lock using a locking hasp and mounted on the external side of the door. The locking mechanism can be operated by the HC cylinder lock from either side of the door, with the locking mechanism encased and protected from all sides to prevent attempted intrusion. The locking bolts of the locking mechanism are operated by movement of the external element which slides in the axial direction along the HC cylinder lock body. The external element may be provided as a sleeve, or slider.

The inventive HC cylinder lock can also be used with locking mechanisms utilizing multiple locking bolts.

In another alternative embodiment, the inventive HC cylinder lock may be incorporated in a padlock replacement, using a multi-bolt locking mechanism fixedly mounted external to a door. The multi-bolt locking mechanism operates using an external element which slides along the length of the HC cylinder lock, to move the multiple locking bolts. The multiple locking bolts of the locking mechanism engage a locking hasp mounted to the doorpost. The entire HC cylinder lock and locking mechanism is encased and fully protected from tampering or breakage by unauthorized intrusion.

In a further embodiment, the inventive HC cylinder lock can be incorporated in a high security, rotating bolt lock which engages a locking hasp, using a slider with an integrally formed actuator for developing bolt rotation by engaging an eccentric pin formed as part of the rotating bolt. The lock designed to be mounted on the external surface of a door at the entrance side.

Additional features and advantages of the present invention will become apparent from the following drawings and description.

BRIEF DESCRIPTION OF THE DRAWINGS

For a better understanding of the invention with regard to the embodiments thereof, reference is made to the accompanying drawings, not shown to scale, in which numerals designate corresponding elements or sections throughout, and in which.

DETAILED DESCRIPTION OF THE PREFERRED EMBODIMENTS

FIGS. 1-4 representing the prior art have been described above in the Background.

Figures 5, 6:
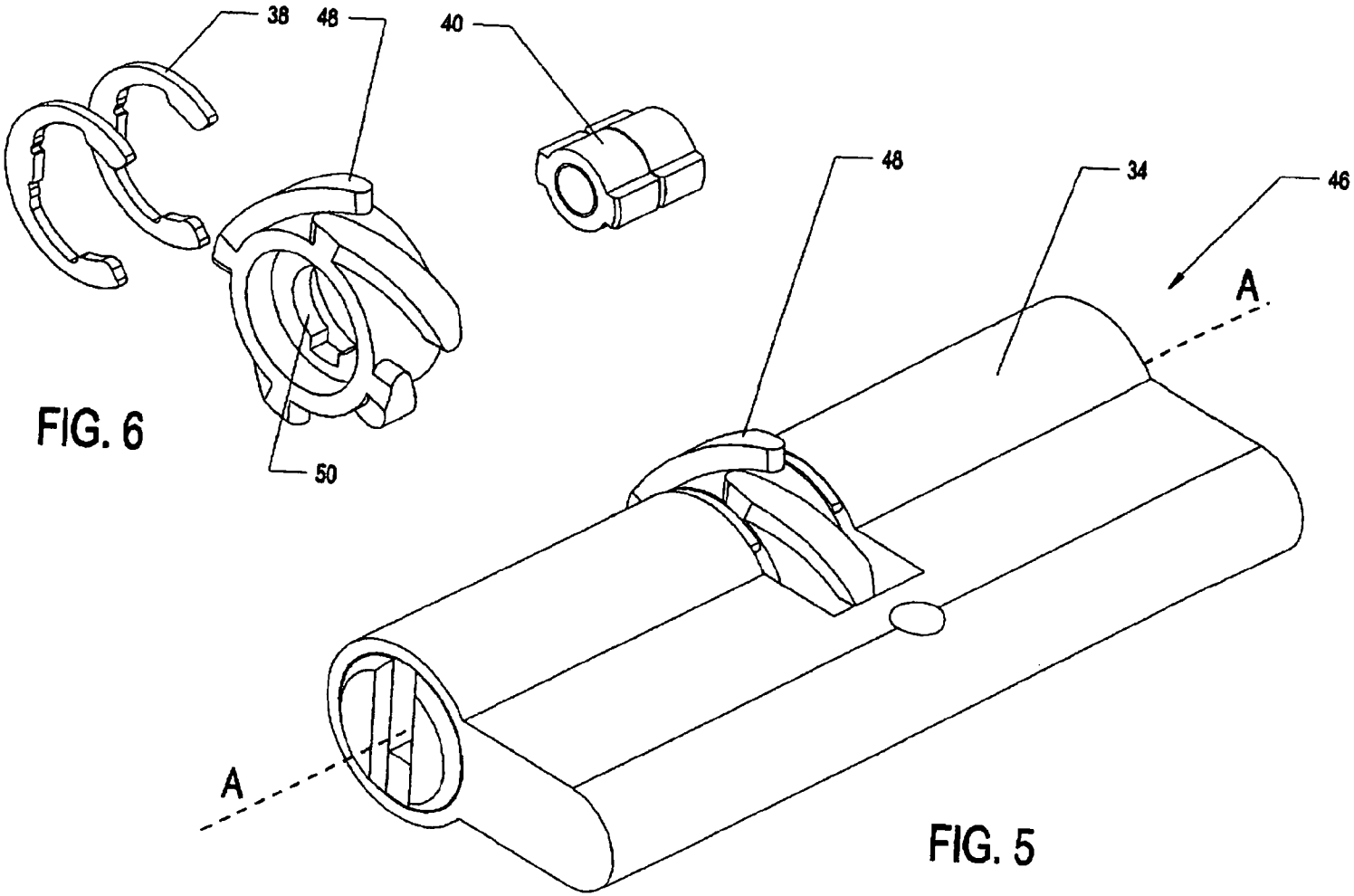
FIG. 5 is a perspective view of a preferred embodiment of a cylinder lock designed with a helical cam (HC) for enabling motion of an external element along the cylinder lock body, in accordance with the principles of the present invention.
FIG. 6 is an exploded view of several components of the HC cylinder lock shown in FIG. 5, featuring a helical cam, coupling and circlips.

Referring now to FIG. 5, there is shown a preferred embodiment of a cylinder lock having a modified cam and being arranged for slidable, axial motion of an external element (not shown) along the cylinder lock body length, constructed and operated in accordance with the principles of the present invention.

In the first example of a preferred embodiment of a double cylinder lock 34 arranged with an external element (see FIGS. 7-9), the traditional cam 36 or gear 44 is replaced by a helical cam 48. The cam is formed with at least one helical thread section, or more, as shown in following examples. The helical thread sections of the helical cam 48 can be designed for right or left-hand orientation with a variable pitch. FIG. 6 shows an example of a helical cam 48 which has four helical thread sections and a right-hand orientation. In this design, a full rotation of the key causes the movable sleeve to slide approximately 30 mm, along the cylinder lock body which has a typical length of 76 mm.

In FIG. 5 it can be seen how the helical cam 48 is mounted in a standard double cylinder lock 34, hereinafter referred to as a helical cam (HC) cylinder lock. It is important to note that the helical cam 48 is arranged to be mounted on the cylinder plug 35 in the same fashion with the circlips 38, and replaces the standard cam 36 or gear 44 that are currently used with common cylinder locks. Similarly the interior cavity 50 of the helical cam 48 matches that of the standard cam 36 and gear 44 and therefore can accommodate the insertion of the coupling assembly 40. The advantage of these design specifications is to ensure that only a minimum number of components need to be modified or replaced to incorporate the new technology into current lock manufacturing and production facilities.

As shown in FIG. 5, an axial line A-A is drawn through the center of the circular part of the cylinder lock 34, i.e. through the center of the section containing the keyway. Line A-A is also aligned with the center of the helical cam 48. From hereinafter, usage of the term "axial direction" is to be understood as the direction coincident with the axial line A-A.

FIG. 6 is an exploded view of several components of the HC cylinder lock 34 shown in FIG. 5, featuring a cam 48, coupling 40 and circlips 38.

Figures 7, 8, 9:
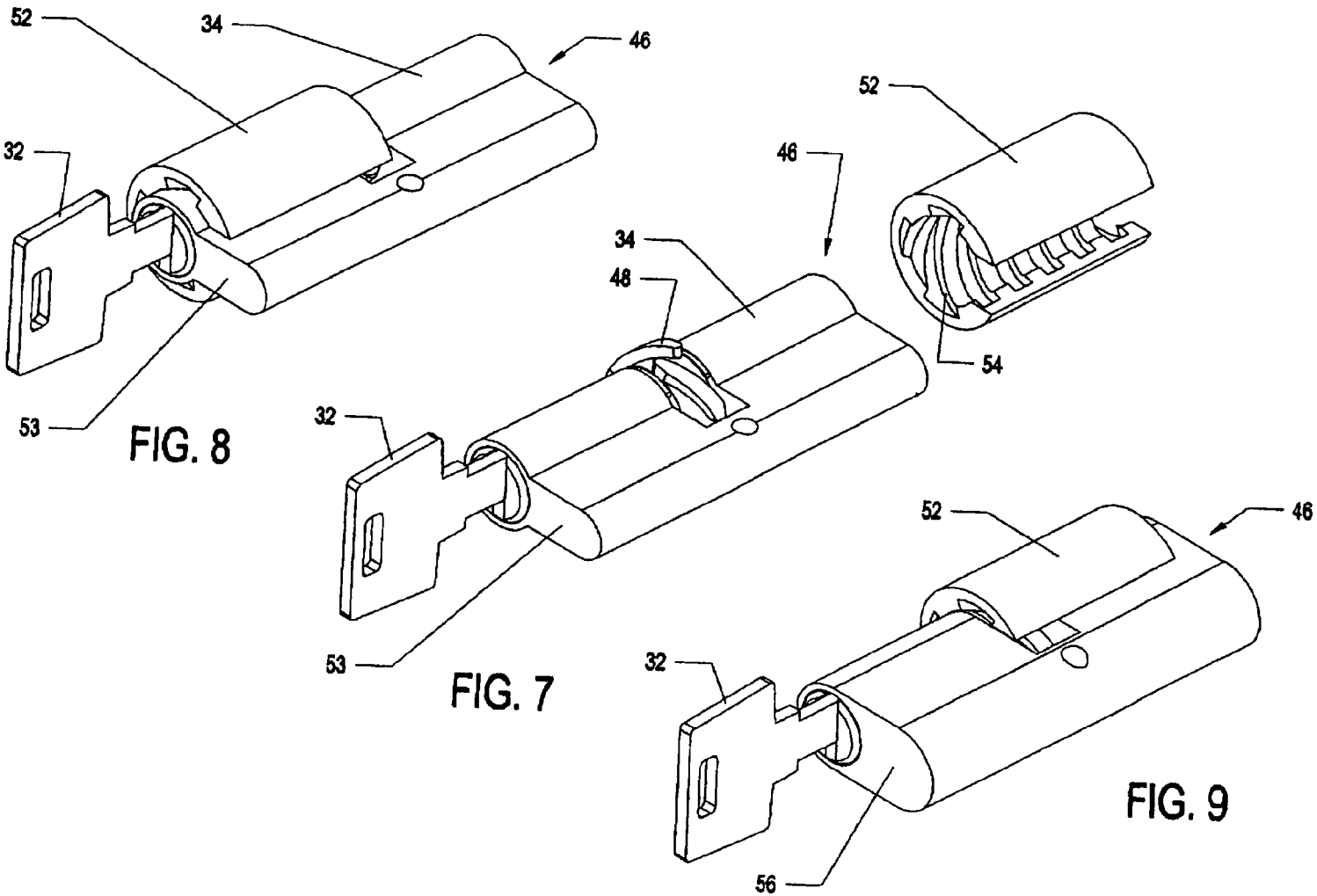
FIG. 7 is a perspective view of the inventive HC cylinder lock, showing an external element arranged for sliding motion on the cylinder lock body.
FIGS. 8-9 show, respectively, the position of the external element on front and rear ends of the HC cylinder lock body.

FIG. 7 is a perspective view of the inventive cylinder lock, showing the external element 52 provided as a movable sleeve arranged for sliding motion along the body of HC cylinder lock 34. The external element 52 has an inner thread 54 which is designed to match the threaded sections formed on helical cam 48.

This embodiment of the device, comprising a key 32, double cylinder lock 34, helical cam 48, external element 52 and all other cylinder lock internal components (not shown) shall hereinafter be called the external element-type HC cylinder lock 46.

In operation of the external element-type HC cylinder lock 46, the rotation of key 32 inside cylinder lock 34 causes helical cam 48 to rotate, and the threaded sections of helical cam 48 engage the matching inner thread 54 of external element 52. This engagement serves to translate the rotational motion of helical cam 48 into linear motion of external element 52 backwards or forwards in the axial direction, dependent on the direction of rotation of key 32. The inner diameter of the sleeve-shaped external element 52 is designed to fit properly around the body of HC cylinder lock 34 to guide its motion in the axial direction with minimal friction.

FIGS. 8-9 show, respectively, the position of the external element 52 on the key end and the opposite end of the HC cylinder lock 34 body.

Referring now to FIG. 8, the external element 52 is positioned on the key end of the HC cylinder lock 34. When key 32 is rotated 360 degrees, external element 52 becomes displaced the length of the HC cylinder lock 34 as it is driven by the rotation of helical cam 48. The key 32 may then be removed after each full revolution.

Referring now to FIG. 9, the new position of external element 52 is shown, for example, after a full revolution of key 32. The example shown moves external element 52 from the key end of HC cylinder lock 34 to the opposite end along the axial direction of HC cylinder lock 34.

It can be seen that the profile 53 of HC cylinder lock 34 in FIG. 8 is not the same as that of cylinder lock 56 in FIG. 9. This change was drawn to demonstrate that the concept being discussed can be applied to alternative profiles of cylinder locks. Additionally, there is no concern that there will be excessive displacement of external element 52, causing it to disengage from the HC cylinder lock 34, as movement of external element 52 will be guided by a housing (not shown) as well.

Figures 10, 11, 12:
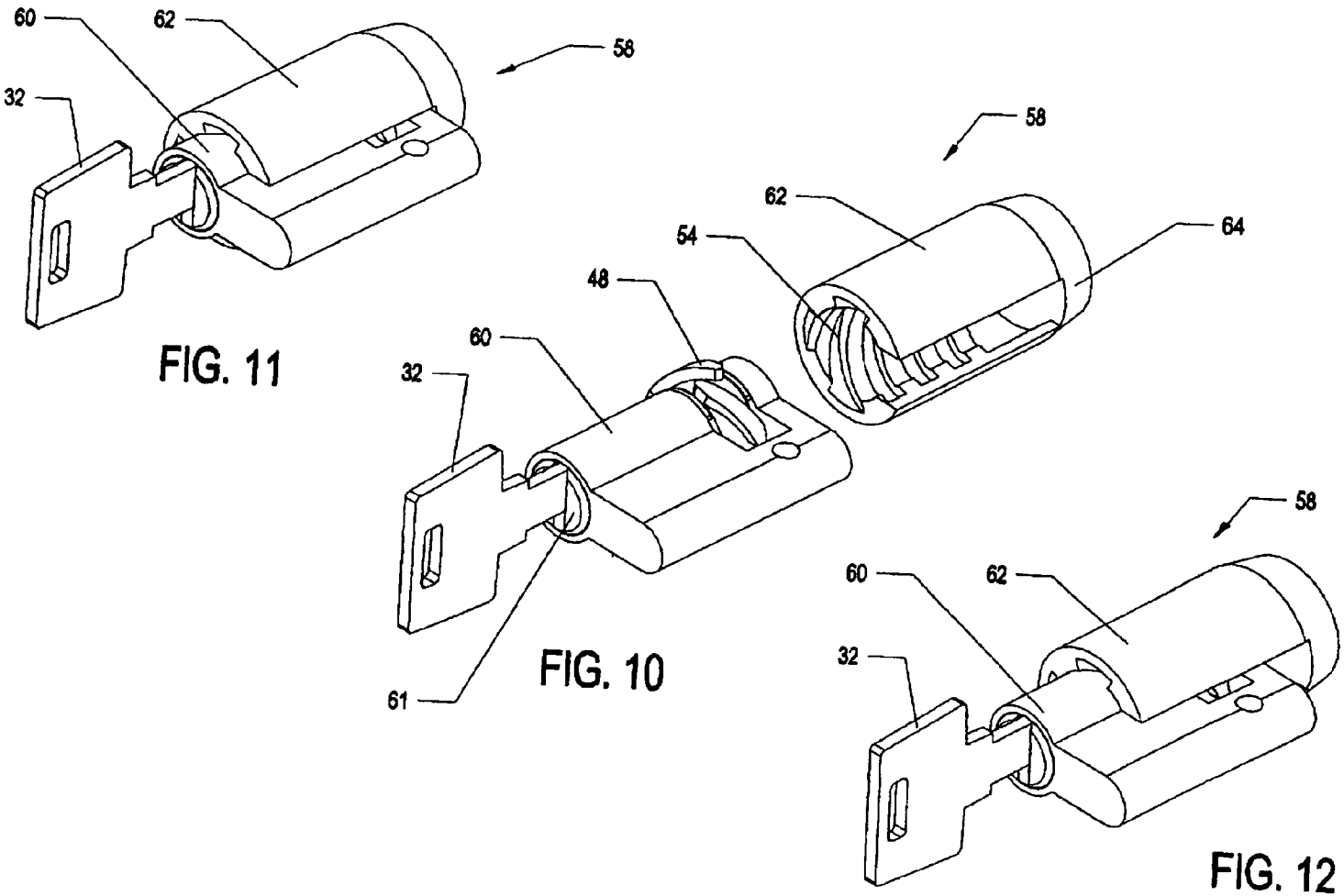
FIG. 10 is a perspective view of another embodiment of the inventive HC cylinder lock, showing a reinforced-end external element arranged for sliding motion on a single cylinder lock body.
FIGS. 11-12 show the external element in alternative positions on the HC single cylinder lock body.

In FIGS. 10-12, there is shown a single cylinder lock 60. Mounted on single cylinder lock 60 is a variation of the external element shown with external element-type HC cylinder lock 46. When compared with external element 52 which was shown earlier, it can be seen that this external element is shaped as a sleeve 62 with a reinforced end 64, which is adapted to serve as a locking bolt. The reinforced-end external element 62 has the same helical thread 54 and diameter as external element 52.

This embodiment of the device, comprising a key 32, a single cylinder lock 60, rotatable cylinder plug 61, helical cam 48, reinforced-end external element 62 and common cylinder lock internal components (not shown) shall hereinafter be called the reinforced-end-type HC cylinder lock 58.

The advantage of reinforced-end type HC cylinder lock 58 is that it can be used itself as the locking bolt which will secure devices as will be explained below.

Referring now to FIG. 11, reinforced-end-type HC cylinder lock 58 is shown in its retracted mode, i.e. reinforced-end external element 62 is in the closest position to the key 32.

In FIG. 12 the key has been rotated a full turn and the reinforced-end external element 62 has moved in the axial direction, increasing the distance of the reinforced-end external element 62 from the key 32, into the extended position. This extended mode can be used to lock devices as will be explained below.

In the current example, the reinforced-end-type HC cylinder lock 58 may not require a full revolution of the key 32 to provide the movement desired. If the key 32 is turned about a quarter revolution, or about ninety degrees, this will result in a 7.5 mm movement by the reinforced-end external element 62, which in the present embodiment will be sufficient to lock a device.

Figures 13, 14, 15:
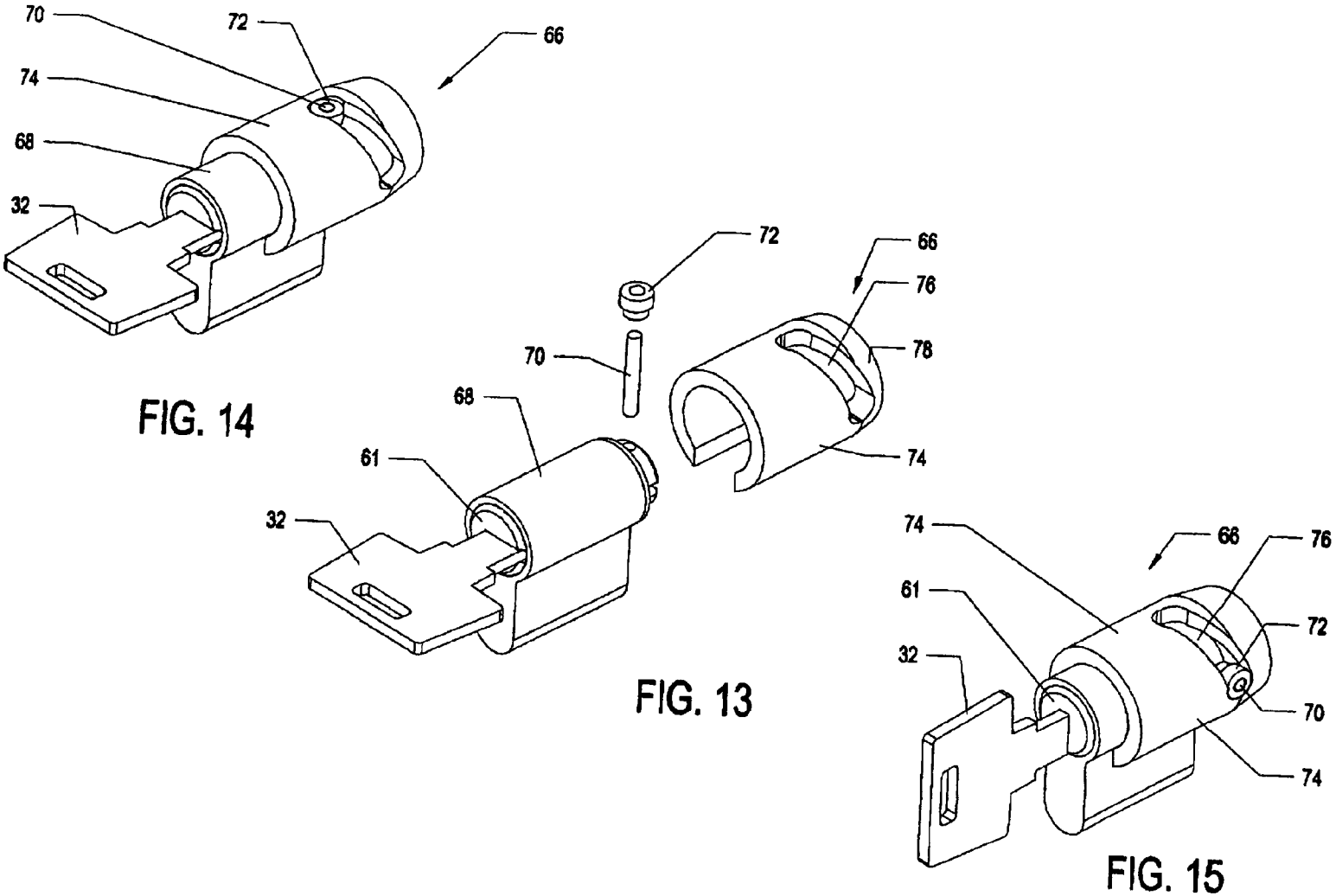
FIGS. 13-15 show an alternative external element design, featuring a single helical slot construction, arranged for sliding motion on a single cylinder lock body.

FIGS. 13-15 show an alternative construction of an external element that operates on a similar rotation-to-axial motion principle as in the previous embodiment.

This embodiment of the device, comprising a key 32, a single cylinder lock 68, pin 70, roller 72, helical slotted-reinforced-end external element 74 and internal components (not shown) shall hereinafter be called the helical slot, reinforced-end-type cylinder lock 66.

The reinforced-end external element 74 has a helical slot 76 that runs spirally along a portion of its length. The angle of the spiral slot facilitates axial motion of the external element as will be explained below. The helical slot, reinforced-end external element 74 is mounted on a single cylinder lock 68, which has a pin 70 inserted in the cylinder plug 35 and arranged for rotation together with it. In the present embodiment, the pin has a roller 72 mounted on it. The roller 72 is inserted in the spiral slot 76 of the helical slot, reinforced-end external element 74 and serves to reduce friction during the motion of the pin 70 along the length of the helical slot 76. The roller 72 is not an essential feature of the design.

Figure 16:
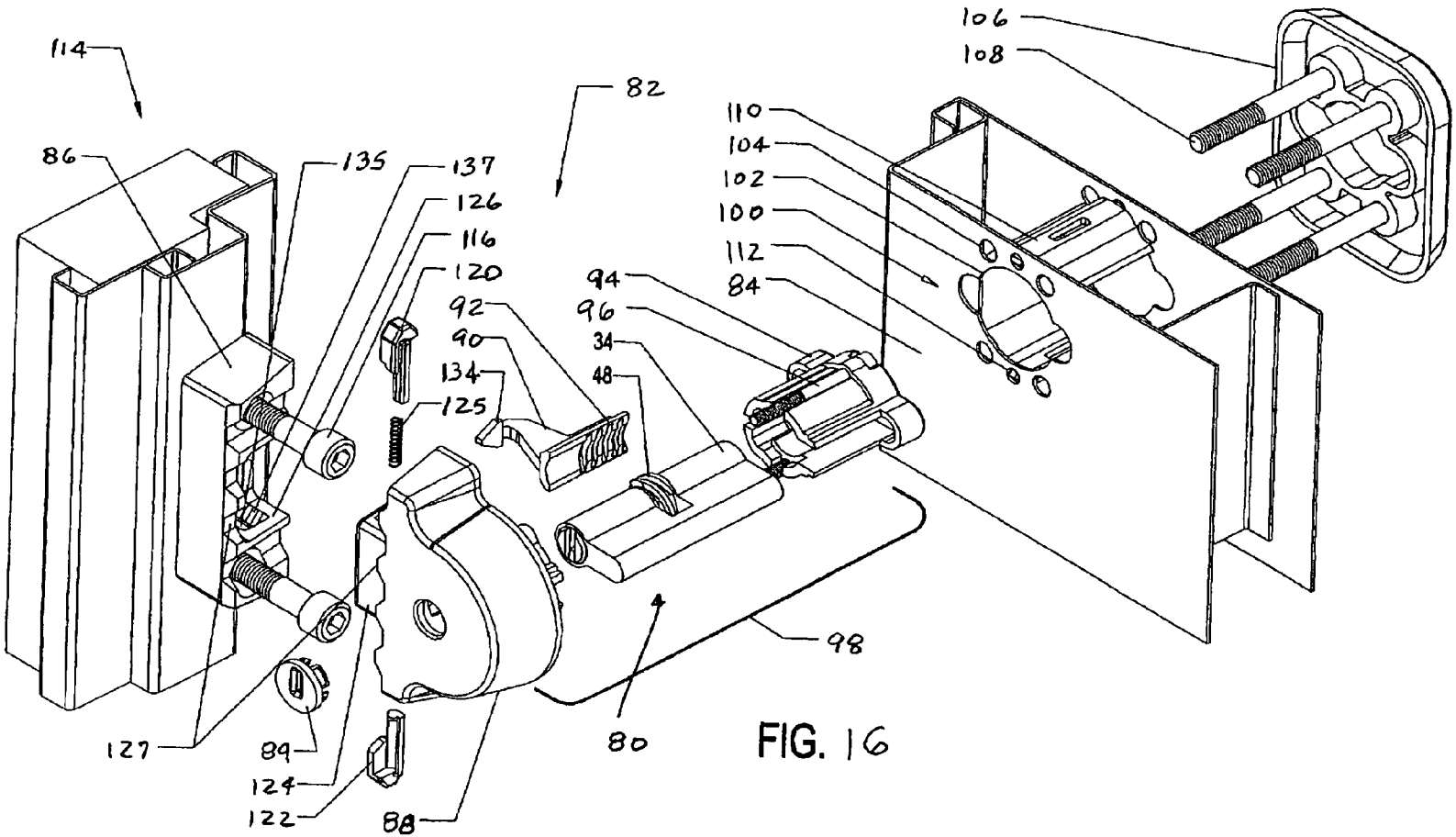
FIG. 16 is an embodiment of a high security, multi-bolt lock equipped with the external element-type HC cylinder lock, which utilizes a single winged external element and an actuator having sloped surfaces, designed to be mounted on the external surface of a door at the entrance side.

In operation, the helical slot, reinforced-end type cylinder lock 66 may be initially positioned in the locked or extended position shown in FIG. 14. When the key 32 is rotated about a quarter revolution inside the single cylinder lock 68, it cannot be removed. The pin 70 rotates with the cylinder plug 61 by the same amount. It is important to note the pin 70 does not move in the axial direction with respect to the cylinder lock 68. As the pin 70 rotates within helical slot 76 (as seen in FIG. 16), the helical slot, reinforced-end external element 74 is moved in the axial direction. The retracted position of the helical slot, reinforced-end external element 74 with respect to the cylinder lock 68 is shown in FIG. 15. In this embodiment the ends of the slot 76 restrict the motion of the pin 70 and therefore the rotation of the key 32 to about a quarter revolution.

In application, the extended position of the helical slot, reinforced-end type cylinder lock 66 can be used to lock a device, as the reinforced end 78 of the external element 74 can be utilized as a bolt.

FIG. 16 is an exploded view of a modified multi-bolt, winged external element-type HC cylinder lock 80, operated using HC cylinder lock 34, especially designed as an auxiliary lock 82 to be mounted on the exterior face of a door 84 on the entrance side using an externally mounted locking hasp 86. This embodiment features an external housing 88 integrally formed with an external escutcheon plate. Also shown mounted in the external housing 88 is a rotatable protection disc 89 that is designed to prevent drilling of the keyway. A single winged external element 90 has a partially circumferential sleeve portion 92, unlike the external element 52 of FIG. 7. In this embodiment, single winged external element 90 is guided in its axial motion partially by the HC cylinder lock 34 body, and also by the external housing 88, which supports one end of the HC cylinder lock 34.

The internal housing 94 supports the other end of HC cylinder lock 34, and also provides guidance of the axial motion of single-winged external element 90. The internal housing 94 and the external housing 88 are fastened together by a plurality of bolts 96, forming a solid encasement 98 of the locking assembly containing HC cylinder lock 34, thereby protecting it from any attempted tampering. Once the encasement 98 is completed, the entire construction can be mounted through the external surface of the door 84 by drilling a set of mounting holes 100, with a main hole 102 with an approximate diameter of 40 mm for encasement 98, and a set of auxiliary mounting holes 104 for securing internal escutcheon plate 106 with mounting screws 108.

Prior to installation of the encasement 98 containing the HC cylinder lock 34 within a hollow steel door, a pair of spacers 110 are placed within the hollow door via hole 102 and their ends are snap-fit within an additional set of auxiliary mounting holes 112. Spacers 110 are provided to support the internal structure of the door 84, so that when the internal escutcheon plate 106 is tightened against external housing 88 by tightening the mounting screws 108, there is no risk of deformation of the door profile. The result of tightening the mounting screws 108 creates a strong mechanical connection between the door 84 structure and auxiliary lock 82, greatly strengthening the mounting area of auxiliary lock 82 against forced entry and tampering.

The locking hasp 86 is mounted to the external side of the door frame 114 by two strong mounting bolts 116. Locking hasp 86 is engaged by a locking mechanism 118 (see FIGS. 22*a-b*) comprising locking bolts 120 and 122, which are seated in a locking compartment 124 which forms part of external housing 88. Locking compartment 124 has both locking bolts 120, 122 seated therein in a normally open state, under spring force provided by spring 125. Locking bolts 120, 122 are arranged to protrude from locking compartment 124 so as to engage locking bays 126 in locking hasp 86.

It is a particular feature of this embodiment that the external housing 88, although shown in FIG. 16 installed on the exterior face of door 84 on the entrance side, can be installed on the door within the dwelling or storage area, etc. In addition, depending on its mounting location, the encased locking assembly can be adapted as needed for use with sliding doors, single or double swinging doors, rolling shutters, etc.

As shown, locking hasp 86 has patterned edges 127 which match those of the external housing 88. When the door is in the closed position, these edges are capable of preventing an attempted intrusion or attack using a crowbar or other tool.

Figure 18:
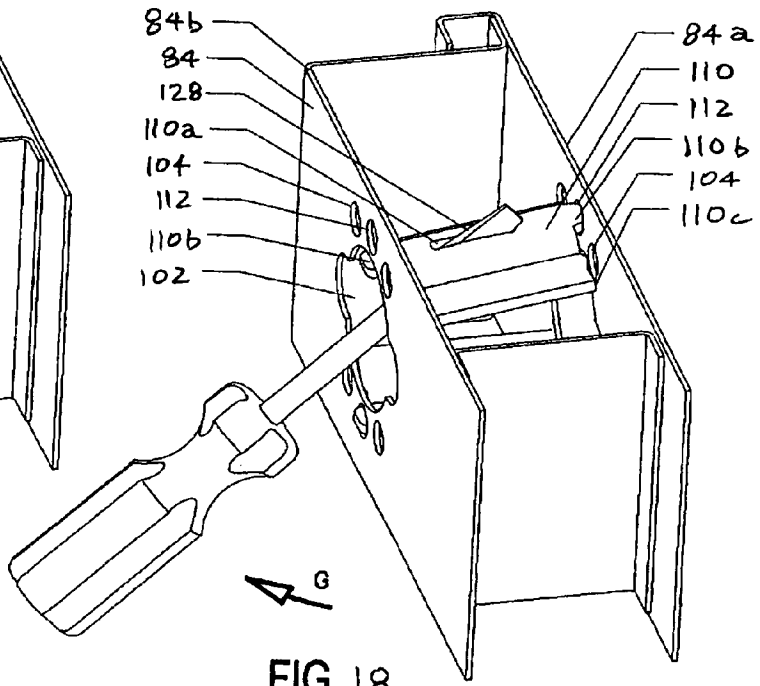
FIGS. 17-18 are perspective views of a section of a hollow steel door formed with mounting holes, showing a method for inserting a spacer used to support the door interior.
Figure 17:
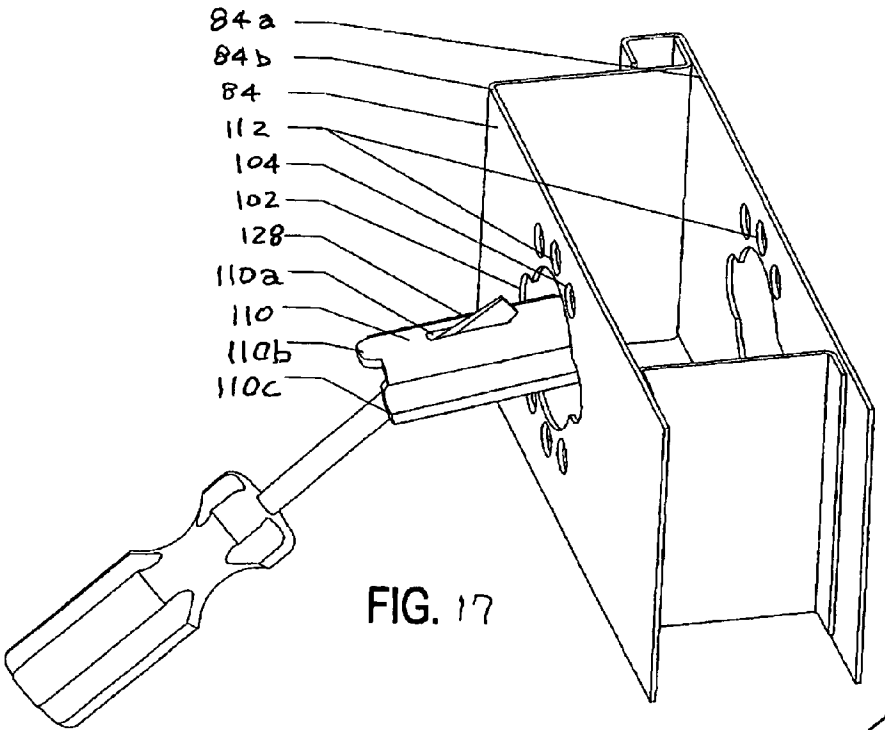

FIGS. 17-18 are perspective views of a section of a hollow steel door formed with mounting hole 102, showing a method for inserting a spacer used to support the door interior. The spacer may be inserted as part of the door production at the factory, or it may be inserted in mounting hole 102 formed in the door at the construction site. In either case, the spacer need not be welded to the door, thus simplifying the addition of the spacer to the door.

In order to insert the spacer 110 through the hole 102, a flat, standard screwdriver 128 is inserted into specially-designed slot 110*a* of spacer 110, which has a slot width for gripping the screwdriver end, so that the spacer 110 does not fall within the door interior once inserted via hole 102. The spacer 110 is shaped at each of both ends with a protrusion 110*b*, and shoulders 110*c*. When the spacer 110 is inserted through hole 102 using the screwdriver 128, a first protrusion 110*b* is inserted into hole 112, which serves as an anchor point. Then screwdriver 128 is rotated in the direction of arrow "G", so that the spacer 110 forces the door surfaces 84*a-b* away from each other, enabling a second protrusion 110*b* to snap into place in hole 112. The protrusions are designed to develop friction with the holes 112, so as to maintain the spacer 110 in a desired orientation. The shoulders 110*c* are then aligned with the set of auxiliary mounting holes 104. Tightening of mounting screws 108 creates a strong mechanical connection between the door 84 structure and auxiliary lock 82.

Figure 19:
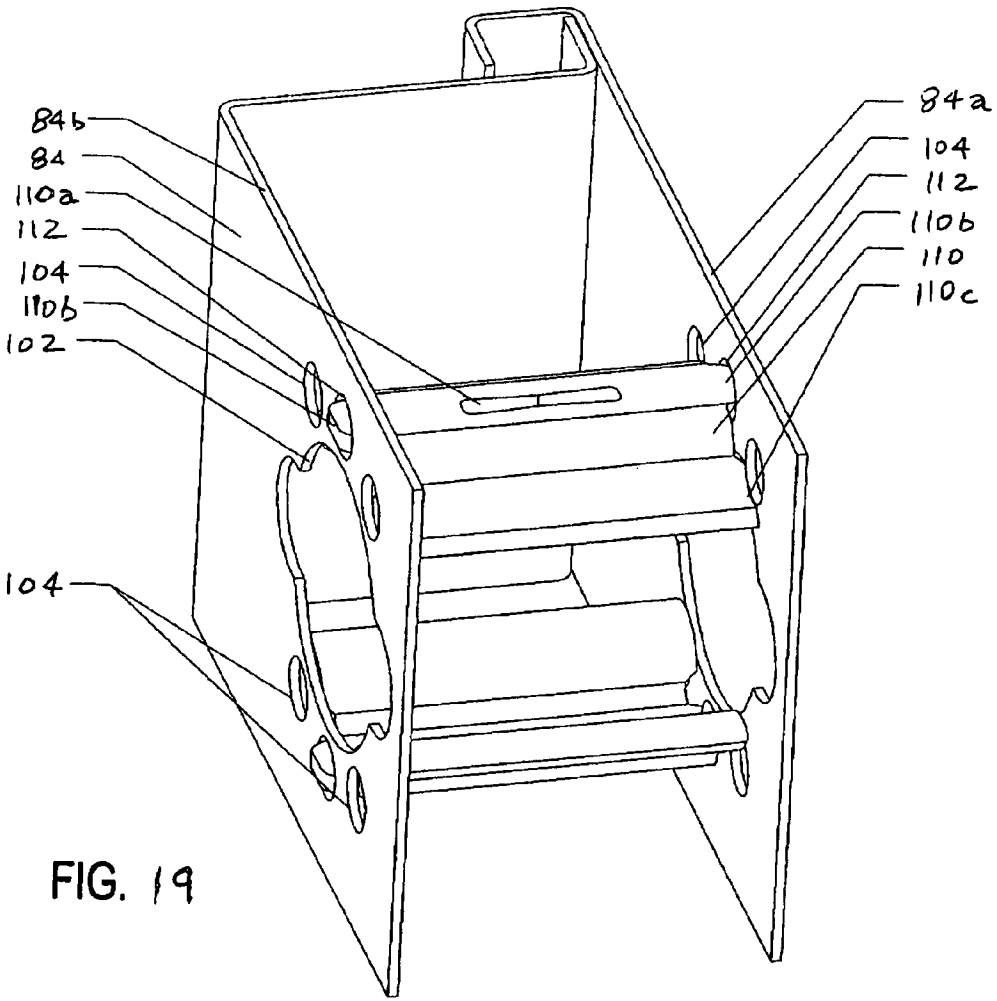
FIG. 19 is a perspective view of the door section of FIGS. 17-18, after mounting the spacers.

FIG. 19 is a perspective view of the door section of FIGS. 17-18, after mounting the spacers.

Figure 2:
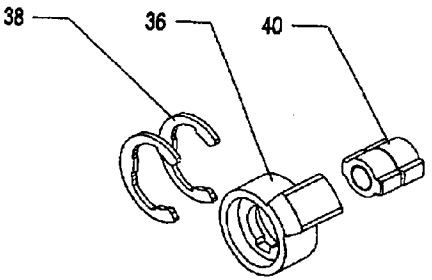
FIG. 2 PRIOR ART
FIG. 2 is an exploded view of some of the cylinder lock components shown in FIG. 1, featuring a cam, coupling and circlips.
Figure 4:
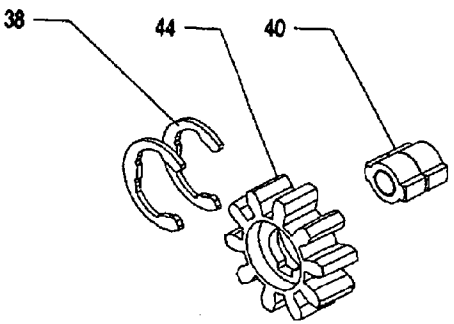
FIG. 4 PRIOR ART
FIG. 4 is an exploded view of several components of the cylinder lock shown in FIG. 3.
Figure 1:
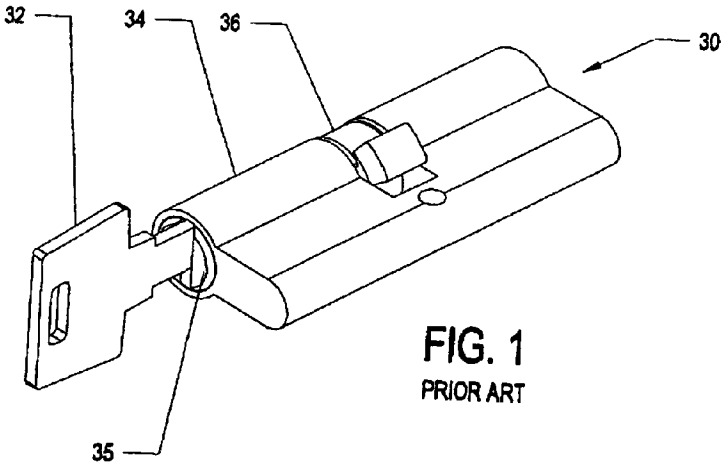
FIG. 1 PRIOR ART
FIG. 1 is a prior art illustration showing a European profile double cylinder lock with a single tooth cam.
Figure 3:
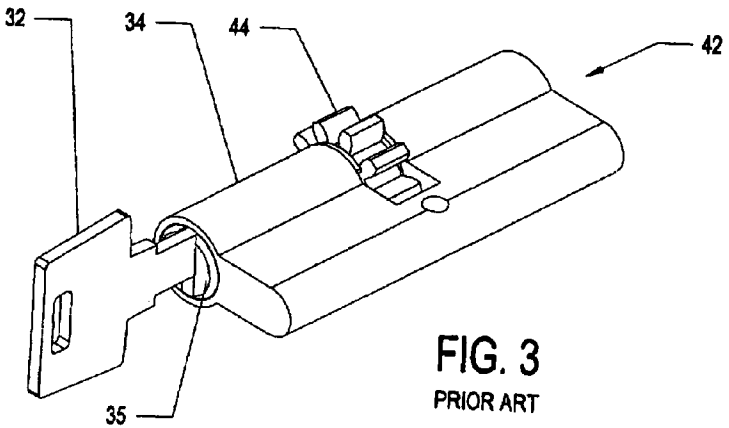
FIG. 3 PRIOR ART
FIG. 3 is a prior art illustration showing a European profile double cylinder lock with a gear.
Figure 20:
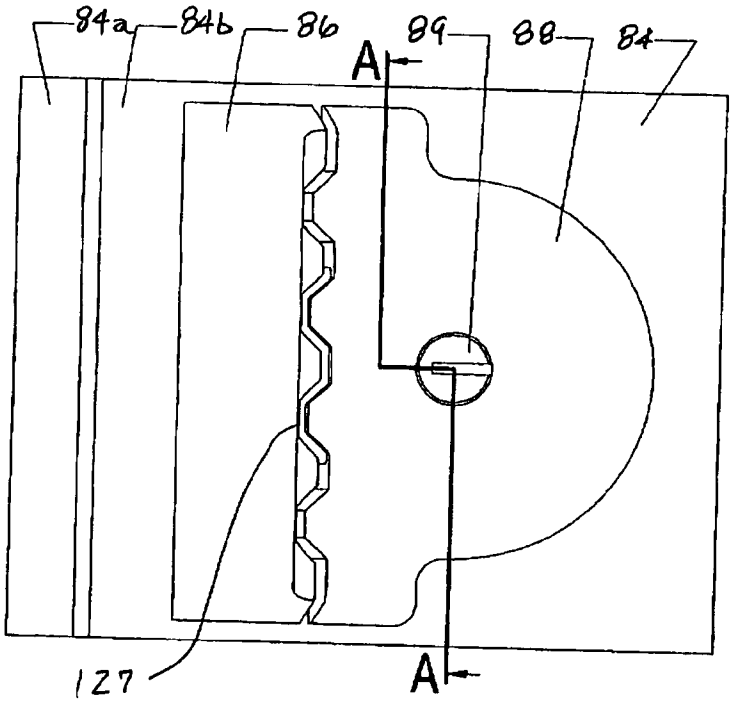
FIG. 20 is a front view of the door section having an auxiliary lock mounted on the external door section surface shown in FIG. 19.

FIG. 20 is a front view of the door section having the auxiliary lock 82 of FIG. 1.6 mounted on the external door section surface shown in FIG. 19.

Figure 21:
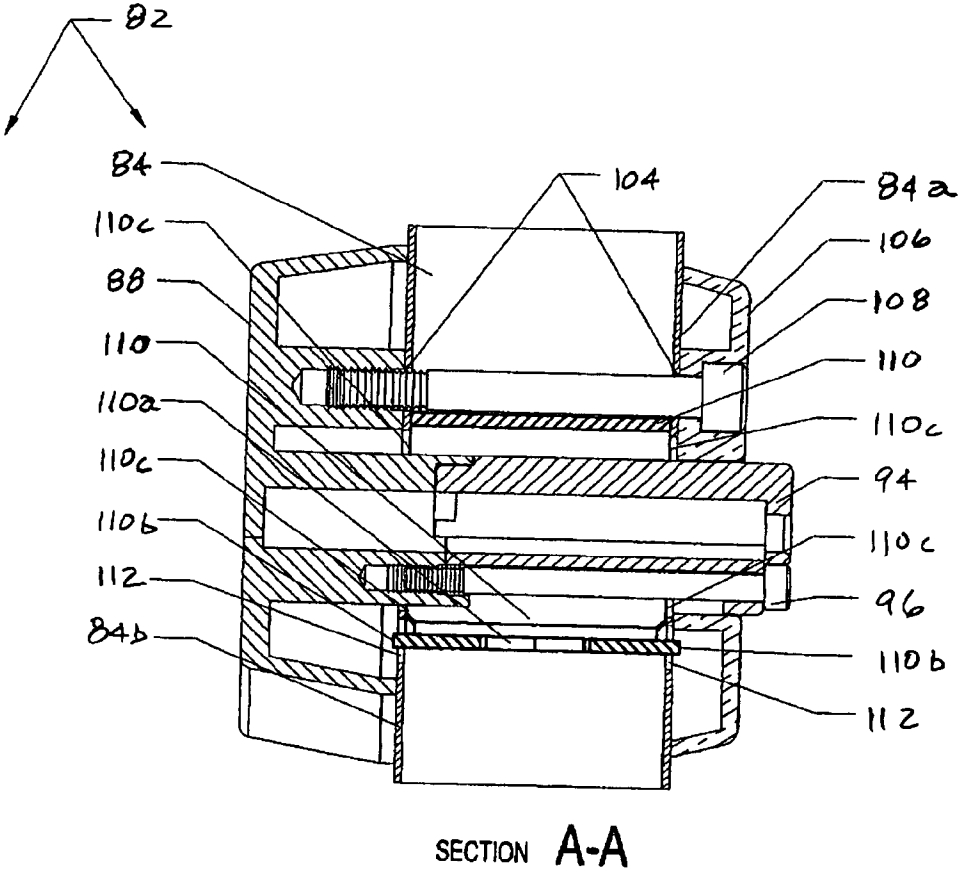
FIG. 21 is a cross-sectional view of the door section shown in FIG. 20, taken along section lines A-A, showing the spacers used to support the door interior, with the external element-type HC cylinder lock mounted in position.

FIG. 21 is a cross-sectional view of the door section shown in FIG. 20, taken along section lines A-A, showing the spacers 110 used to support the door interior, with the auxiliary lock 82 mounted in position.

The operation of the auxiliary lock 82 embodiment of FIG. 16 is now described. As shown in FIG. 22*a*, the wing portion of single winged external element 90 has formed at its distal end an actuator 134 having sloped surfaces. In a locking operation of HC cylinder lock 34, actuator 134 engages sloped edges 136 of locking bolts 120, 122 as a result of axial motion of single-winged external element 90. Thus, locking bolts are forced to slide apart and protrude from locking compartment 124, so as to provide locking engagement with locking hasp 86.

Figure 22B:
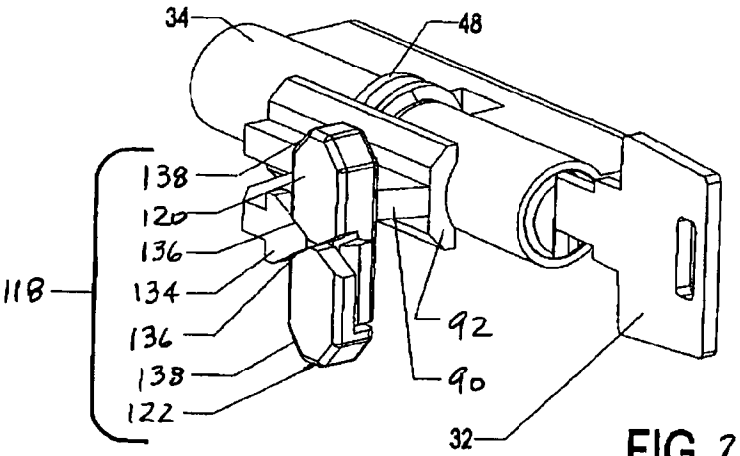
FIGS. 22*a-b* show the operation of the actuator on the locking bolts of the high-security, multi-bolt lock equipped with the external element-type HC cylinder lock of FIG. 16.
Figure 22A:
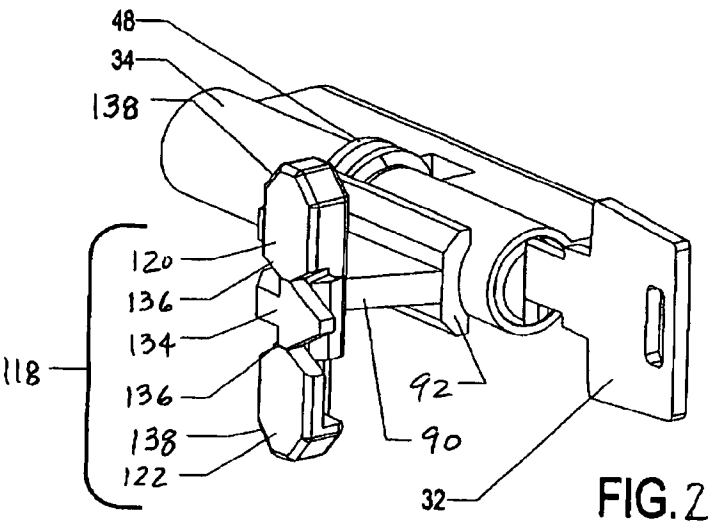

As shown in FIG. 22*b*, reversal of the axial motion of the single-winged external element 90 by an unlocking motion of HC cylinder lock 34, results in retraction of actuator 134, and return of the locking bolts 120, 122 into the unlocked position when they slide together, by spring pressure (spring 125—see FIG. 16).

Figure 23:
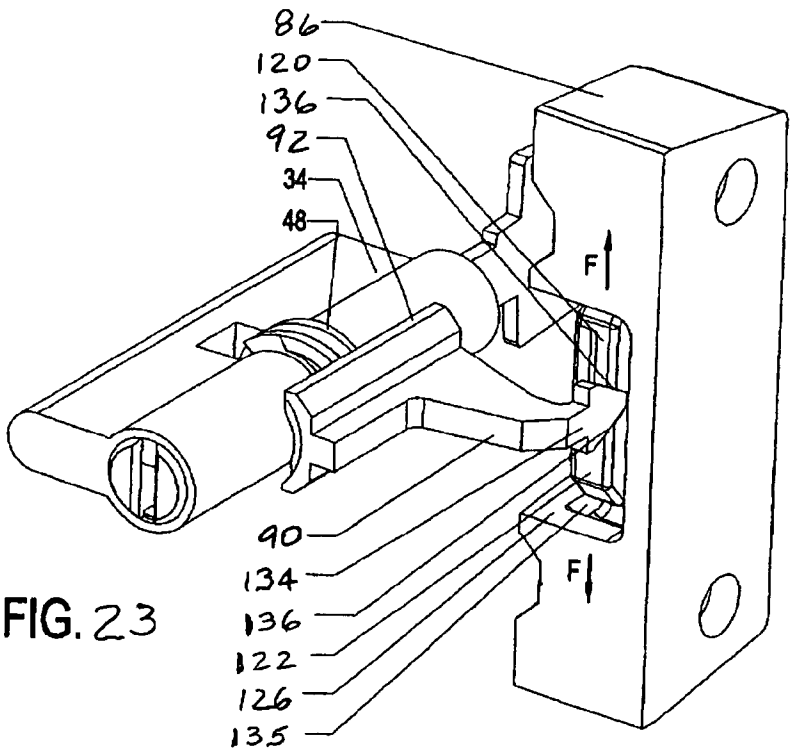
FIG. 23 shows an alternative orientation of the high-security, multi-bolt lock equipped with the external element-type HC cylinder lock, featuring the operation of the actuator and locking bolts within a locking hasp.

In FIG. 23, a different orientation of the arrangement of locking hasp 86 is shown, featuring the locking mechanism 118 comprising locking bolts 120 and 122. The operation of single winged external element 90 and actuator 134 is clearly visible against the sloped surfaces 136 of locking bolts 120, 122. When the locking bolts 120, 122 are forced apart by actuator 134 in the direction of arrows F-F, each of them is urged into a locking cavity 135 formed at the opposite ends of locking bay 126. Each of the locking cavities 135 is formed with a sloped surface 137 (see FIG. 16). A feature of the design is the provision of sloped edges 138 on external ends of locking bolts 120, 122 to assist spring 125 in developing sliding motion of the locking bolts 120, 122 together under an opening force applied by the user to open the door 84. The opening force will be transferred via the slopes 136 of locking cavity 135 to force locking bolts 120, 122 together, releasing them from locking cavity 135.

Figure 24:
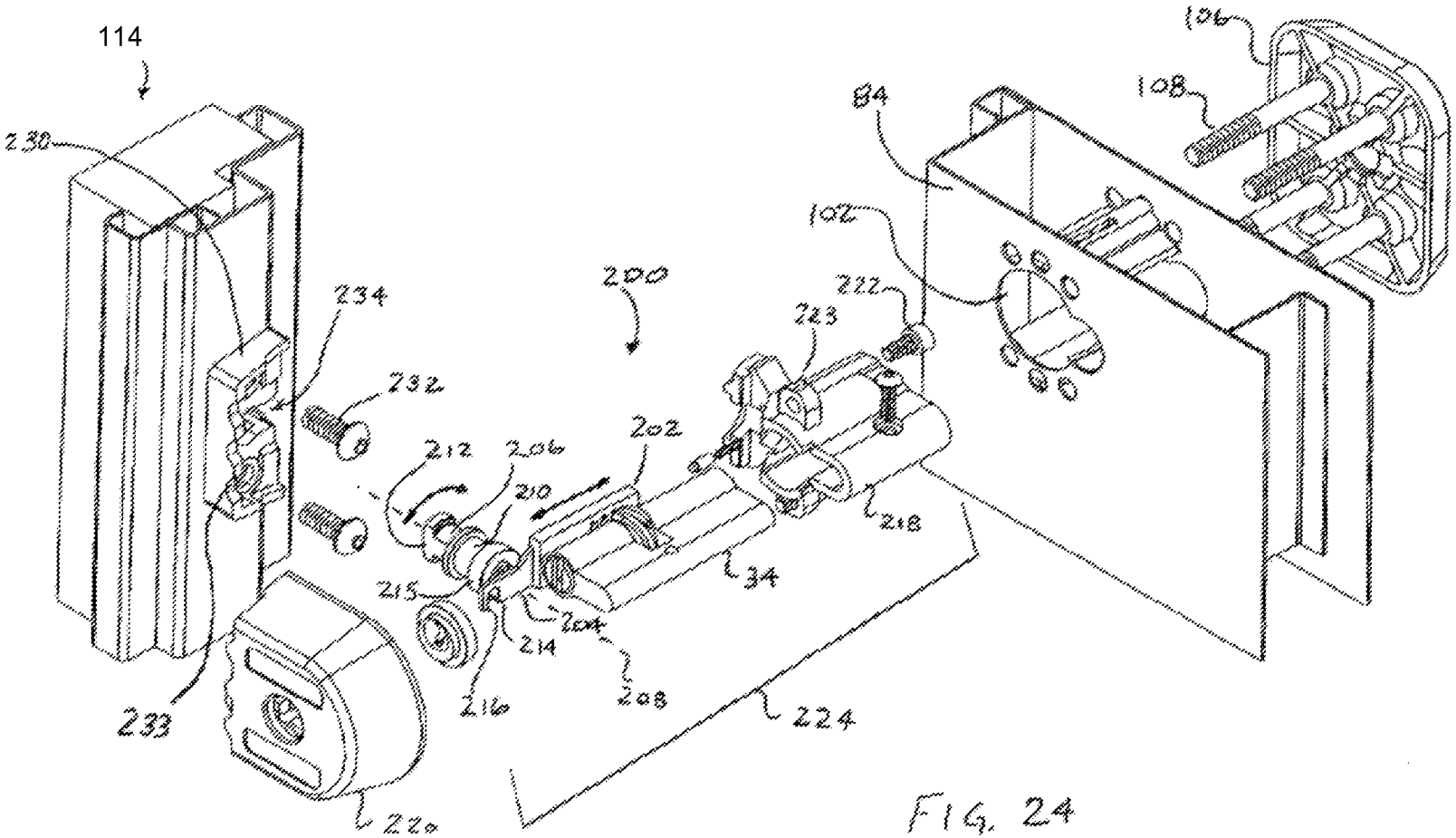
FIG. 24 is an exploded perspective view showing construction of a high security, rotating bolt lock equipped with the HC cylinder lock, which utilizes a slider as the external element with an integrally formed actuator for developing bolt rotation, with the lock designed to be mounted on the external surface of a door at the entrance side.

FIG. 24 is an exploded perspective view showing construction of a high security, rotating bolt lock 200 equipped with the double HC cylinder lock 34. Rotating bolt lock 200 utilizes a slider 202 with an integrally formed actuator 204 for developing bolt rotation, with the lock designed to be mounted on the external surface of a door at the entrance side. The rotating bolt lock 200 can be mounted on the door during production of the door at the factory, or it can be mounted on a door at the construction site. Locking bolt 206 extends along an axis 208 which is perpendicular to the axis of rotation of the HC cylinder lock 34, and bolt 206 extends along a bolt pin 210 which has the shape of an anchor at its locking end, and is formed with a truncated disc-shaped flat head 212 having a larger diameter than the bolt pin itself. An eccentric pin 214 formed on section 215 of bolt 206 at its actuation end engages a slot 216 formed in actuator 204.

Rotating bolt lock 200 is arranged to have one of its ends mounted in an internal housing 218 which is dimensioned so as to be mounted within a hole 102 formed in door 84. The internal housing 218 and the external housing 220 are fastened together by screws 222 via mounting holes 223, forming a solid encasement 224 of the locking assembly containing HC cylinder lock 34, thereby protecting it from any attempted tampering. The mounting arrangement of lock 200 within door 84 is similar to that described in relation to the mounting arrangement of lock 82 as shown in FIG. 16.

The locking hasp 230 is mounted to the external side of the door frame 114 by two strong mounting bolts 232 via mounting holes 233. Locking hasp 230 is mounted so that its locking bay 234 becomes engaged with locking bolt 206 (see FIGS. 25-31) during locking operation of the HC cylinder lock 34.

It is a particular feature of this embodiment that the external housing 220, although shown in FIG. 24 installed on the exterior face of door 84 on the entrance side, can be installed on the door within the dwelling or storage area, etc. In addition, depending on its mounting location, the encased locking assembly can be adapted as needed for use with sliding doors, single or double swinging doors, rolling shutters, etc.

Figures 25, 26, 27:
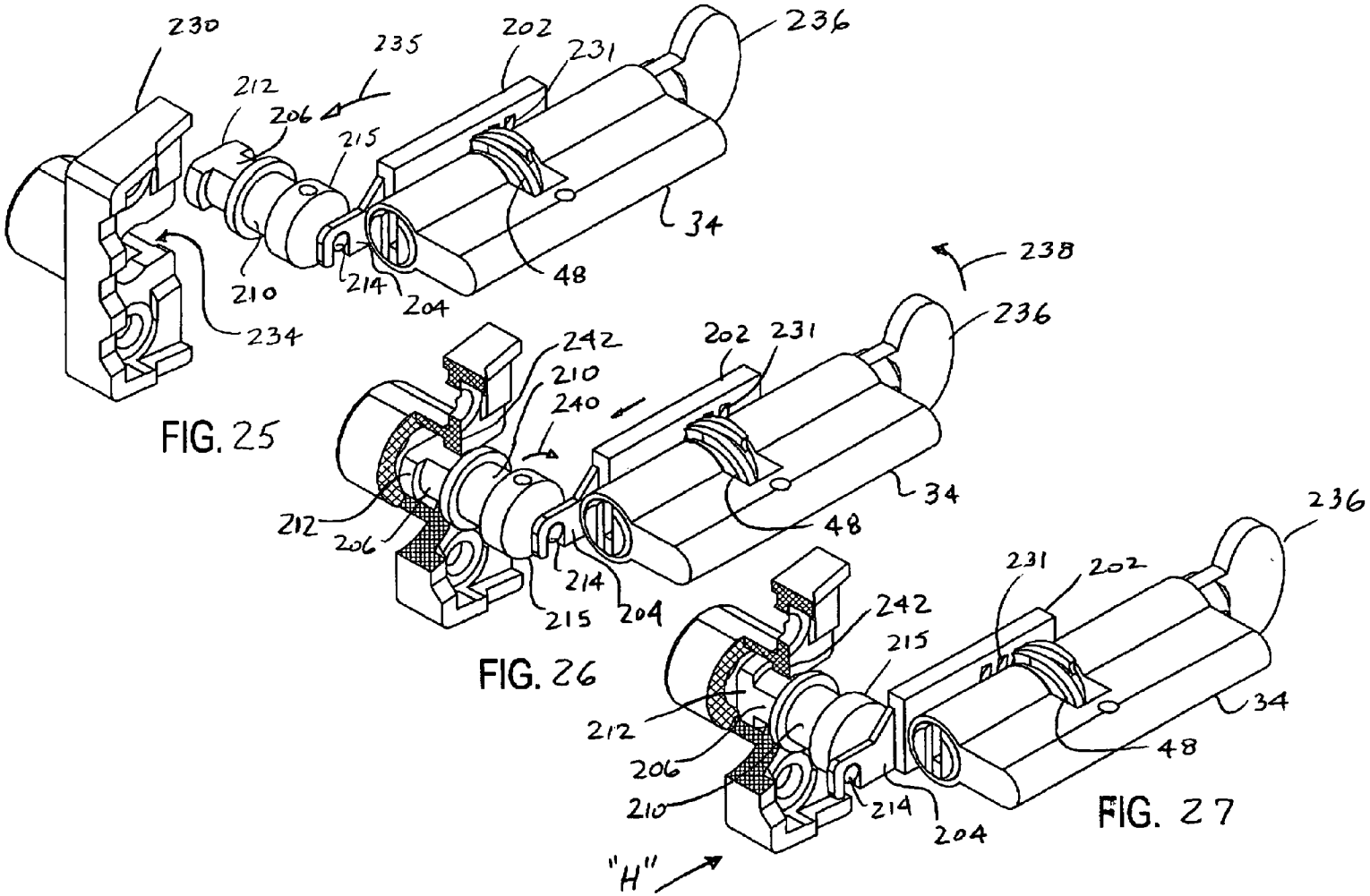
FIG. 25 is a perspective view of the rotating bolt lock of FIG. 42, showing an enlargement of the HC cylinder lock, and the slider with integral actuator shaped to engage an eccentric pin formed as part of the rotating bolt, shown before engaging a locking hasp.
FIG. 26 is a partial cutaway view of the locking hasp and the rotating bolt which engages it, illustrating the rotating bolt after engaging the locking hasp, before being rotated into the locked position.
FIG. 27 is a perspective view of the rotating bolt lock of FIGS. 42-44, showing the rotating bolt rotated into the locked position.

FIG. 25 is a perspective view of the rotating bolt lock 200 of FIG. 24, showing an enlargement of HC cylinder lock 34, Slider 202 has a grooved section 231 which is designed to match the threaded sections formed on helical cam 48. Slider 202 also has an integral actuator 204 shaped to engage eccentric pin 214 formed as part of the rotating locking bolt 206, shown before engaging locking hasp 230. Arrow 235 shows the direction of movement of the door 84 which brings rotating bolt 206 into engagement with locking hasp 230.

As shown in the perspective cutaway view of the locking hasp shown in FIG. 26, when the door 84 is closed, rotating bolt 206 engages locking hasp 230, before bolt 206 is rotated into the locked position. From inside of the door 84, operating knob 236 can be rotated to operate HC cylinder lock 34. The operating knob 236 can also be operated by rotation of a key (not shown).

As shown in the perspective view of FIG. 26, by rotation of the operating knob 236 as shown by arrow 238, slider 202 moves forward and drives eccentric pin 214 so that rotating bolt 206 rotates into the locked position (arrow 240).

As shown in FIG. 27, arrow H indicates a front view direction for a description of the rotating bolt 206 of lock 200. Additional detail of the locking operation of rotating bolt 206 and the locked state of lock 200 can be seen in the drawing FIGS. 28-31 which show, respectively, a front view (FIG. 28), a cross-sectional view (FIG. 29) taken along section lines C-C, a right-hand side view (FIG. 30) and cross-sectional view (FIG. 31) taken along section lines B-B.

Figure 29:
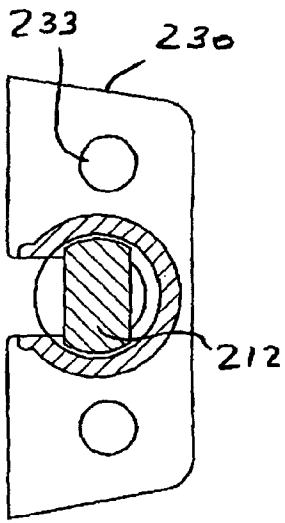
FIGS. 28-31 show the rotating bolt lock, respectively, in a front view, a cross-sectional view taken along section lines C-C, a right-hand side view, and a cross-sectional view taken along section lines B-B.
Figure 28:
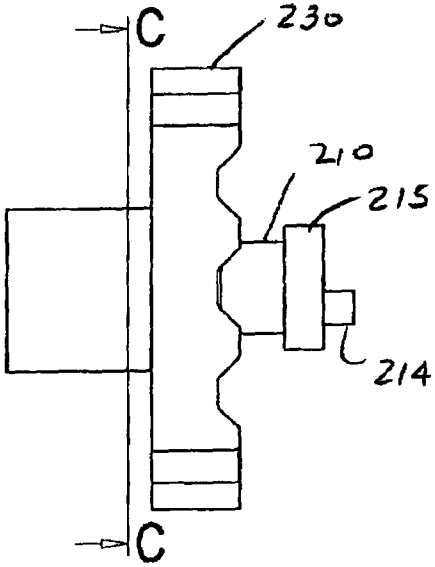

In the front view of FIG. 28, rotating bolt lock 200 is locked and the rotating bolt 206 engages locking hasp 230, as shown in the cross-sectional view of FIG. 29. A locking flange 242 formed in locking hasp 230 engages the flat head 212 of rotating bolt 206, thereby providing rotating bolt lock 200 with multi-directional locking. The rotating bolt 206 is secured within locking hasp 230 against motion in the vertical, horizontal and longitudinal directions, resulting in high security and preventing any attempt at tampering with the lock.

Figure 30:
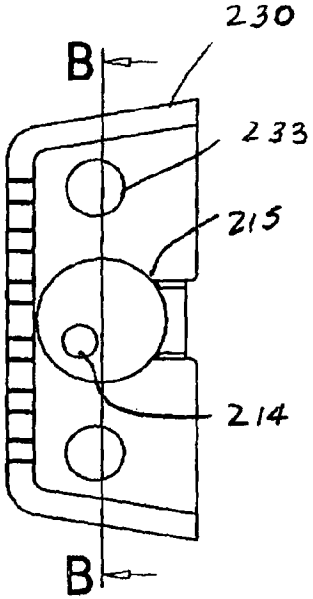
Figure 31:
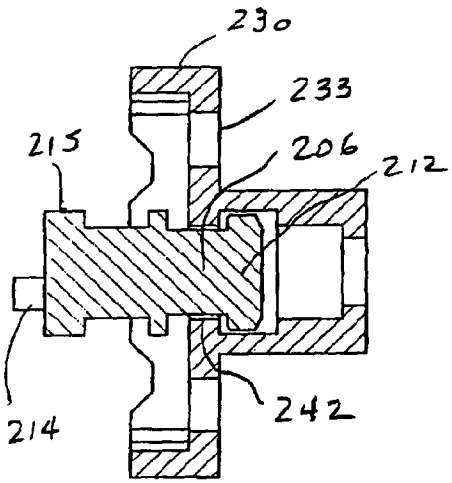

FIGS. 30-31 show, respectively, the right-hand side view of rotating bolt 206 of lock 200, and its corresponding cross-sectional view, providing further detail of the multi-directional locking feature of the rotating bolt lock 200 of the present invention.

Having described the invention with regard to certain specific embodiments thereof, it is to be understood that the description is not meant as a limitation, since further modifications will now suggest themselves to those skilled in the art, and it is intended to cover such modifications as fall within the scope of the appended claims.

I claim:

1. In a cylinder lock constructed as a body having at least one cylinder plug rotatably disposed therein, said at least one cylinder plug having both a key end and a non-key opposite end, the improvement comprising: a modified cam disposed at said cylinder plug non-key opposite end, said cam having at least one thread, said cylinder lock being adapted for moving an external element arranged to engage said modified cam, said external element being arranged to slide along said cylinder lock body at least partially between said key end and said non-key opposite end upon rotation of said at least one cylinder plug, wherein said external element is linked to a rotating bolt which rotates in response to said sliding motion of said external element, to provide a locking action.

2. The cylinder lock of claim 1, wherein said rotating bolt rotates on an axis orthogonal to said at least one cylinder plug rotation.

3. The cylinder lock of claim 1, wherein said modified cam comprises a plurality of helical-shaped threads.

4. The cylinder lock of claim 3, wherein said external element has formed therein a threaded groove matching said helical thread section formed on said modified cam, thereby providing said engagement of said external element and said modified cam.

5. A door locking mechanism utilizing the cylinder lock of claim 1, provided with a locking hasp for locking engagement of said rotating bolt therewith, said locking hasp being mounted on an external entrance side of a door, with said door locking mechanism being operable by the cylinder lock from either side of the door.

6. The door locking mechanism of claim 5 wherein said locking engagement of said rotating bolt and said locking hasp provides multi-directional security against tampering.

7. The door locking mechanism of claim 5, wherein said door locking mechanism is encased and protected from all sides to prevent attempted intrusion.

8. The door locking mechanism of claim 5, wherein said door locking mechanism is provided with a patterned edge which engages a patterned edge of said locking hasp, to prevent forced intrusion.

9. A door locking mechanism utilizing the cylinder lock of claim 1, further comprising a spacer element for supporting the internal structure of a hollow metal door, placed within said internal structure of said door as part of the door production at the factory or at an installation site thereof, said spacer element enabling proper tightening of mounting screws of said door locking mechanism seated within said door via a hole formed in said door proximate to said spacer element, without deforming the door profile, and providing a strong mechanical connection with the door structure, thus strengthening the mounting area of said door locking mechanism.

10. The door locking mechanism of claim 9, wherein the spacer element is designed for insertion within said internal structure of the hollow metal door via said hole formed as a main mounting hole prepared for the insertion of said locking mechanism.

11. The door locking mechanism of claim 10, wherein the spacer element is formed with protrusions on each of both ends, and shoulders, such that when the spacer is inserted through said main mounting hole, a first protrusion is inserted in an auxiliary mounting hole, which serves as an anchor point, enabling snap-fit of a second protrusion to complete the mounting.

12. The door locking mechanism of claim 10, wherein the spacer element has been inserted within said internal structure of the hollow metal door by a method incorporating use of a standard, flat screwdriver which engages a specially-designed slot formed in said spacer element as it is placed through said hole, thereby preventing said spacer element from falling within the door interior during installation.

13. The door locking mechanism of claim 10, wherein said protrusions of the spacer element are formed so as to create friction with said door internal structure, thereby maintaining said spacer element in a desired orientation.

14. In a cylinder lock constructed as a body having at least one cylinder plug rotatably disposed therein, said at least one cylinder plug having both a key end and a non-key opposite end, wherein the improvement comprises: a modified cam disposed at said cylinder plug non-key opposite end, said cam having at least one thread, a method of operating said cylinder lock comprising: providing an external element shaped to engage said cam, and rotating said cylinder plug by an appropriate key, such that said external element slides along said cylinder lock body at least partially between said key end and said non-key opposite end upon rotation of said at least one cylinder plug wherein said external element is arranged to engage an eccentric pin formed as part of a rotating bolt which rotates in response to said sliding motion of said external element, to provide a locking action.

15. A high-security rotating bolt lock comprising a cylinder lock constructed as a body having at least one cylinder plug rotatably disposed therein, said at least one cylinder plug having both a key end and an opposite end, said rotating bolt lock further comprising: a modified cam disposed at said; at least one cylinder plug opposite end, said cam having at least one thread, said cylinder lock being adapted for moving an external element arranged to engage said modified cam, said external element being arranged to slide along said cylinder lock body at least partially between said key end and said opposite end upon rotation of said at least one cylinder plug wherein said external element is arranged to engage an eccentric pin formed as part of a rotating bolt which rotates in response to said sliding motion of said external element, to provide a locking action.

* * * * *